US006540533B1

(12) United States Patent
Schreiber

(10) Patent No.: US 6,540,533 B1
(45) **Date of Patent: *Apr. 1, 2003**

(54) REMOTE ELECTRICAL PLUG EJECTOR

(76) Inventor: James W. Schreiber, 2031 W. Nantucket Ct., Littleton, CO (US) 80120

( * ) Notice: Subject to any disclaimer, the term of this patent is extended or adjusted under 35 U.S.C. 154(b) by 0 days.

This patent is subject to a terminal disclaimer.

(21) Appl. No.: 09/571,129

(22) Filed: May 15, 2000

Related U.S. Application Data

(63) Continuation-in-part of application No. 09/133,015, filed on Aug. 12, 1998, now Pat. No. 6,062,883.
(60) Provisional application No. 60/055,591, filed on Aug. 12, 1997.

(51) Int. Cl.[7] ..... H01R 13/62
(52) U.S. Cl. ..... 439/159; 439/923
(58) Field of Search ..... 439/158, 159, 439/152, 155, 923, 622; 361/1, 117, 139, 111, 120, 170; 307/116, 125, 126, 128, 129

(56) References Cited

U.S. PATENT DOCUMENTS

| | | | | |
|---|---|---|---|---|
| 2,688,734 A | | 9/1954 | Welling | |
| 3,475,715 A | | 10/1969 | Venaleck | |
| 3,784,958 A | | 1/1974 | Harris | |
| 4,820,176 A | * | 4/1989 | Niikura | 439/152 |
| 5,266,040 A | | 11/1993 | Merrill et al. | 439/159 |
| 5,434,509 A | * | 7/1995 | Blades | 324/536 |
| 5,645,439 A | | 7/1997 | Nugent, Jr. et al. | 439/159 |
| 5,800,189 A | * | 9/1998 | Ahmed | 439/159 |
| 6,249,417 B1 | * | 6/2001 | Pippen | 361/139 |

* cited by examiner

*Primary Examiner*—Javaid Nasri
(74) *Attorney, Agent, or Firm*—David A. Greenlee

(57) ABSTRACT

A plug ejector for ejecting an electrical plug from an electrical power supply socket comprises an electronic device having a controller that monitors and senses electrical power supply characteristics and a solenoid, which operates an ejector member to separate the plug from the socket when predetermined sequence in rapid changes in electrical power supply characteristics are sensed. The plug ejector can be incorporated into an electrical appliance or extension power cord electrical plug, which plugs into and is ejected from a conventional power supply socket. It can also be mounted in an adaptor, which receives an appliance or extension cord plug and ejects the adapter from a conventional power supply socket. It can also be incorporated into a module, which is semi-permanently plugged into a conventional power supply socket or incorporated into a wall or other power supply socket. Upon rapid cycling of the appliance's On/Off switch, the solenoid projects the ejector to eject the plug and thus free the appliance or extension power cord from the power supply socket. The plug ejector may incorporate a GFCI protector.

12 Claims, 8 Drawing Sheets

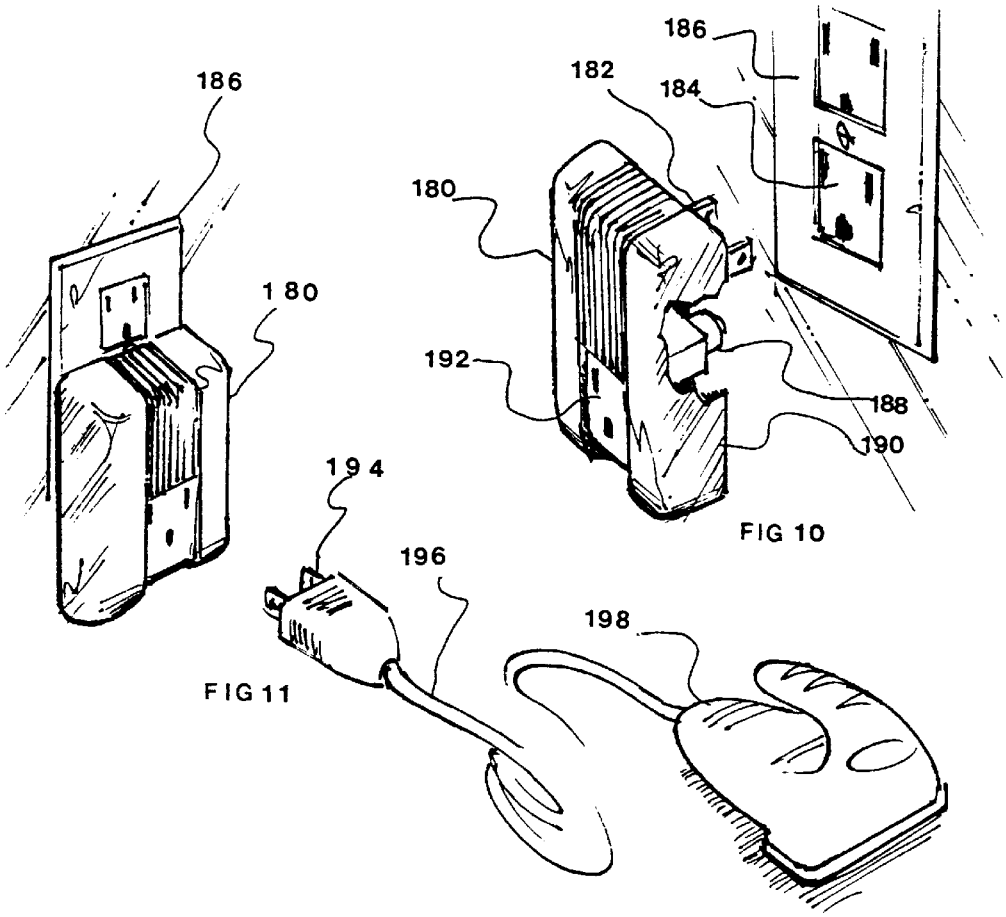
FIG 10
FIG 11
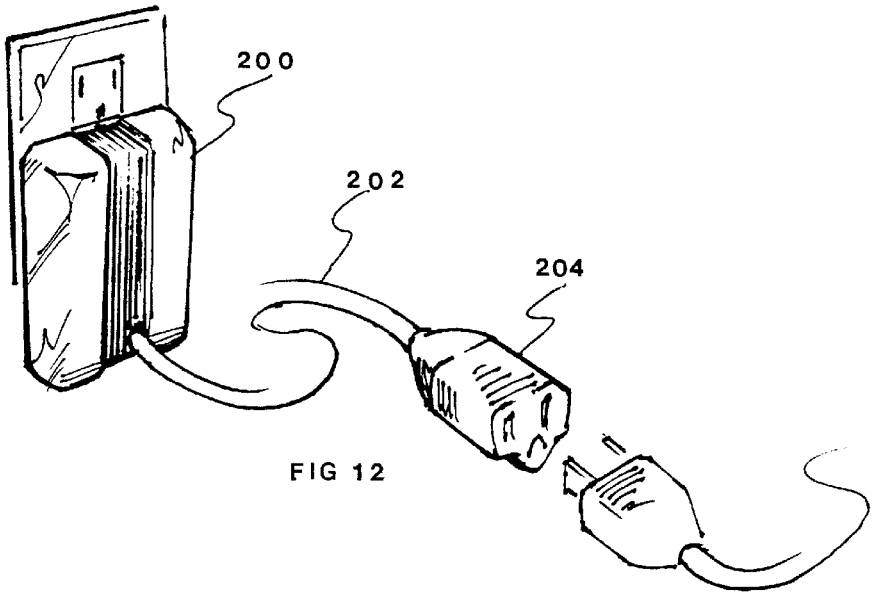
FIG 12

REMOTE ELECTRICAL PLUG EJECTOR

RELATED APPLICATION

This application is a continuation-in-part of Ser. No. 09/133,015 filed Aug. 12, 1998, now U.S. Pat. No. 6,062, 883, issued May 16, 2000, which is incorporated herein by reference, which claims benefit of Provisional No. 60/055, 591 filed Aug. 12,1997.

FIELD OF THE INVENTION

This invention relates generally to electrical plugs and, more particularly, to an ejector system for ejecting an electrical plug from an electrical power supply socket or socket.

BACKGROUND OF THE INVENTION

Many domestic and industrial appliances, such as sweepers and floor polishers, are used over large areas and have very long power cords, which enable their use down long hallways to a location remote from where the power cord is plugged into a wall socket or socket. Other applications involve outdoor equipment, such as used in the building and construction trades, that require long lengths of electrical power cord to access remote work places. In order to continue use of such an appliance or equipment, the operator must walk a long distance to unplug the cord, then walk back and plug the cord into a sequence of widely spaced wall outlets to complete the sweeping, polishing, or other work task. This consumes an excessive amount of unproductive time by the appliance operator. In many instances the appliance operator, in an effort to dislodge the electrical power cord from the remote wall socket, pulls it repeatedly at a severe angle, which bends the prongs and/or tears the power cord components. This accounts for a significant amount of monetary damage to power cord components and to the wall sockets, and can disable the equipment until repaired.

There is a need for a product, which, in conjunction with an appliance, allows the appliance operator to easily unplug the power cord from the remote wall socket and does not require continual manual plugging and unplugging of the power cord from the remote wall socket. There have been many attempts to provide plug ejectors for enabling the remote unplugging of an appliance power cord by manipulating the power cord. Many of these have been patented, as evidenced by U.S. Pat. Nos. 2,394,618; 2,490,580; 2,456, 548; 2,688,734; 2,696,594; 2,986,719; 3,475,715; 3,737, 835; 3,936,123; 4,114,969; 4,045,106; 4,820,176 and 5,704, 811. It is noteworthy that, although this problem was recognized at least as early as 1944, there has been no successful commercialized solution.

In my prior co-pending patent application Ser. No. 09/133015, I provide a device that enables an appliance operator to easily unplug an appliance power cord from a remote electrical wall socket by ejecting the appliance power cord plug from a remote location. This device utilizes a 4-conductor line cord and a separate switch to actuate an electric solenoid to eject an appliance plug from a wall socket. This necessitated extra expense via the use of extra and special equipment. That application anticipated the need for a device that operates off the standard appliance on off switch.

There is also a need for a plug ejector which is compact and inexpensive and which utilizes an appliance's standard on/off switch to operate the plug ejector.

Older electrical sockets tend to be corroded and new sockets are manufactured with a wide range of socket aperture size, which can increase or decrease the frictional force with which it retains the power cord plug prongs. Also, power cord plugs that have been used many times may be bent or crimped due to many instances of off-axis removal. To accommodate the vast variety of forces needed to remove all power cord plugs from all sockets, the plug ejector, solenoid, or motor effecting the ejection must provide significant ejection force, which increases the size and cost of the plug ejector.

Thus, there is also a need for such a plug ejector that minimizes the force required to eject the plug.

There is also a need for a plug ejector which can be incorporated into new appliances as an option, or can be retrofitted to existing appliances and which will reliably eject a power cord plug from any wall socket.

SUMMARY OF THE INVENTION

It is therefore an object of this invention to provide a plug ejector which is compact and inexpensive, and which will reliably eject a plug from a socket.

It is another object to provide a plug ejector, which, when fitted to any appliance, allows the appliance operator to easily unplug the power cord from the remote wall socket and does not require continual manual plugging and unplugging of the power cord from the remote wall socket.

It is another object of this invention to provide a plug ejector that is produced with electronic circuitry that provides a "smart" sensor design to monitor the appliance power cord electrical characteristics and, upon sensing predetermined variations in these characteristics, energizes a system which ultimately ejects an appliance power cord plug from a remote electrical wall socket.

It is another object of this invention to provide a plug ejector that is produced with analog electronic circuitry to activate the plug ejector.

It is another object of this invention to provide a plug ejector that is produced with logic electronic circuitry to activate the plug ejector.

It is another object of this invention to provide a plug ejector that is produced with a microprocessor electronic circuitry to activate the plug ejector.

It is another object of this invention to provide a plug ejector that is produced with electronic circuitry, which does not require an activation switch other than the appliance or equipment on/off switch.

It is another object of this invention to provide a plug ejector which is produced with electronic circuitry that does not require an additional full length power wire incorporated within the standard power cord to allow the plug ejector to function properly, but utilizes an appliance's existing power supply wiring and an appliance's existing on/off switch to activate the plug ejector.

It is another object of this invention to provide a plug ejector that automatically resets itself to a ready position after an appliance operator activates the plug ejector to unplug the appliance power cord from a remote electrical wall socket.

It is another object of this invention to provide a plug ejector, which enables an appliance operator using the appliance at a work location to turn the appliance on and then off and on again without ejecting the appliance power cord from the remote wall socket.

It is another object of this invention to provide a plug ejector that is not affected by common transient pulsations in the electrical power characteristics within the appliance power cord and allows the use of the appliance or other types of equipment without disruption and without ejecting the power cord from the remote wall socket during these common electrical transient events.

It is another object of this invention to provide a plug ejector which is an integral part of a power cord plug assembly connected to the wall socket end of the power cord, which power cord will be assembled onto and made an integral part of an appliance or other type of equipment.

It is another object of this invention to provide a module, incorporating a plug ejector, that can be mounted directly onto a standard wall socket, which allows existing appliances or other types of equipment having conventional power cord plugs to be plugged into and ejected from the module.

It is another object of this invention to provide a separate plug ejector that can be connected to and is adaptable to existing appliance power cord plugs, thus allowing the appliance power cord to be plugged into the adaptor and ejected with the adaptor from the wall socket allowing the cord and adaptor to remain connected.

It is another object of this invention to provide such an adaptor which is incorporated into a power extension cord of any length.

This invention features a plug ejector for ejecting an electrical plug from an electric power supply socket that comprises an electric ejector motor having an ejector member and a controller for monitoring and sensing electrical power supply characteristics and for controlling energization of the motor. When a predetermined sequence of rapid changes in electrical power characteristics is sensed, the controller causes energization of the electric motor to extend the ejector member and eject the plug from the socket.

In one embodiment this invention also features a plug ejector that is carried in the line cord plug of an electrical appliance power supply cord to eject the electrical power supply cord plug from an electrical supply wall socket; comprising standard two or three prong plug assemblies, an impact resistant and non-conductive outer housing, an ejector member mounted internal to the housing for sliding movement between a retracted position and an extended position, an electrical or electronic circuit which senses a change in electrical characteristics, such as voltage, current, and/or power changes in the power supply cord, and triggers the electric motor, and said electric motor moves the ejector member from retracted to extended position impacts the face plate of the wall socket and thereby ejects the plug prongs from the wall socket apertures. Preferably, the electric motor is a solenoid or similar impact device. The plug prongs are connected to the plug ejector motor electrical power leads in a normal fashion and then to power terminals of a remote electric appliance operating switch by an elongated electric power supply cord. The plug ejector electronic components sense rapid sequential on-off operation of the appliance operating switch and energize the electric motor projecting the internal member against the wall socket face plate to eject the plug prongs from the wall socket.

In another embodiment, the plug ejector is a self-contained module having both socket slots for receiving prongs of an electric appliance power cord and also having its own set of electrical prongs to connect to the wall socket, thereby electrically connecting the appliance to the wall socket through the plug ejector. In operation, the module is semi-permanently secured to the wall socket and ejects the plug and attached appliance power cord, while the module remains plugged into the wall socket.

In a further embodiment, this invention features a plug ejector carried by an adaptor, which receives the standard plug of any appliance line cord and is plugged into a wall or other power supply socket. In operation, the adaptor is ejected from the socket and remains with the line cord.

In another embodiment, the plug ejector is an integral part of a separate power extension cord of any length.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 10 is a partially cut-away perspective view of a plug ejector adaptor;

FIG. 11 is a perspective view illustrating the use of the FIG. 10 adaptor with an electrical appliance; and FIG. 12 is a perspective view of a plug ejector adaptor incorporated into the end of an extension cord.

DETAILED DESCRIPTION OF PREFERRED EMBODIMENTS

As disclosed in my co-pending application Ser. No. 09/133015, the electrical circuit of my prior ejector plug shown in FIGS. 1–4 of that application required the use of a separate operating switch and an extra wire in the power supply line cord. This necessitated the use of a unique four-wire line cord. For purposes of comparison only, this circuit is shown in FIG. 4 herein.

Figure 3:
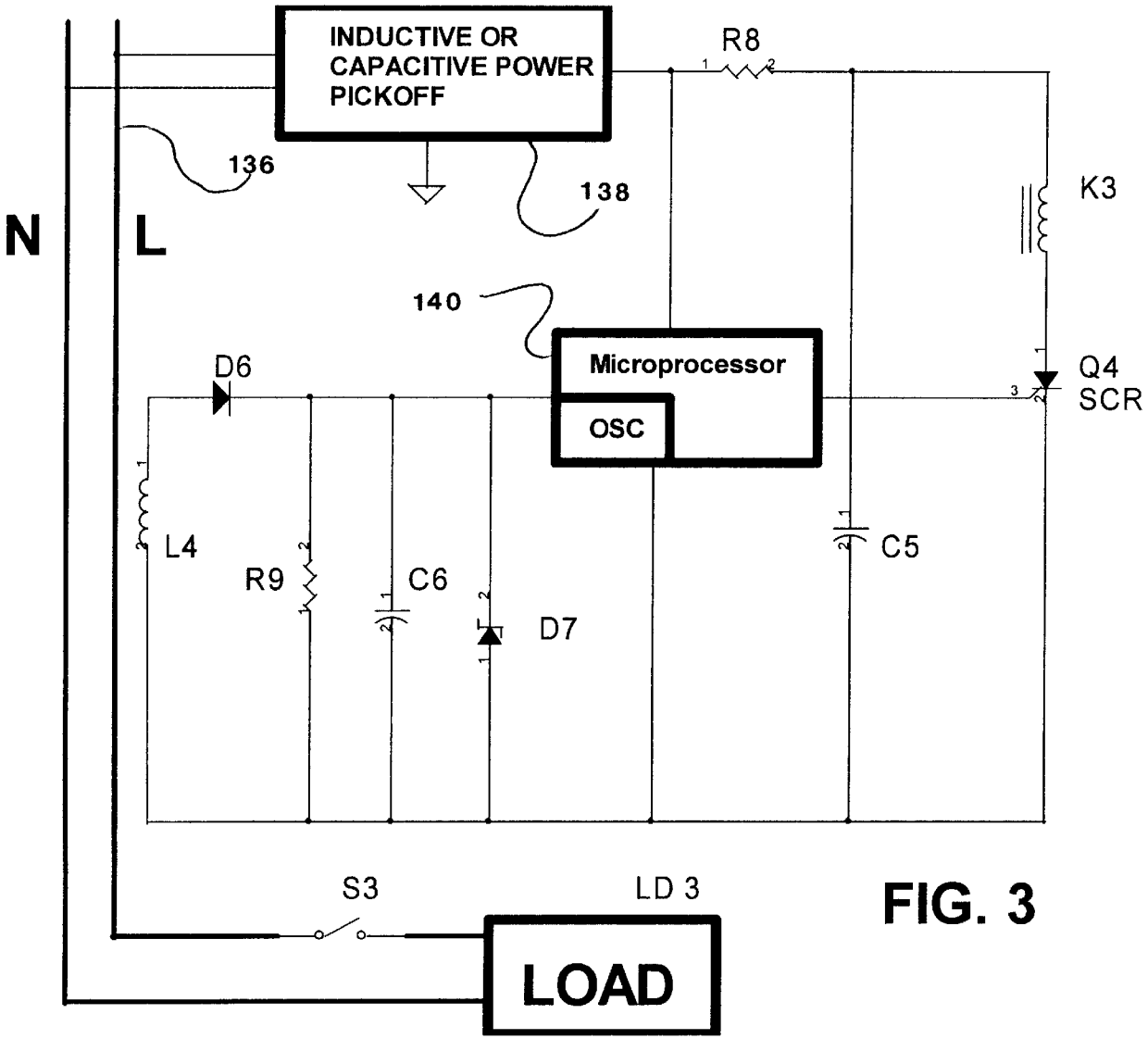
FIG. 3 is a schematic diagram of a microprocessor electronic circuit for controlling a plug ejector according to this invention.
Figure 4:
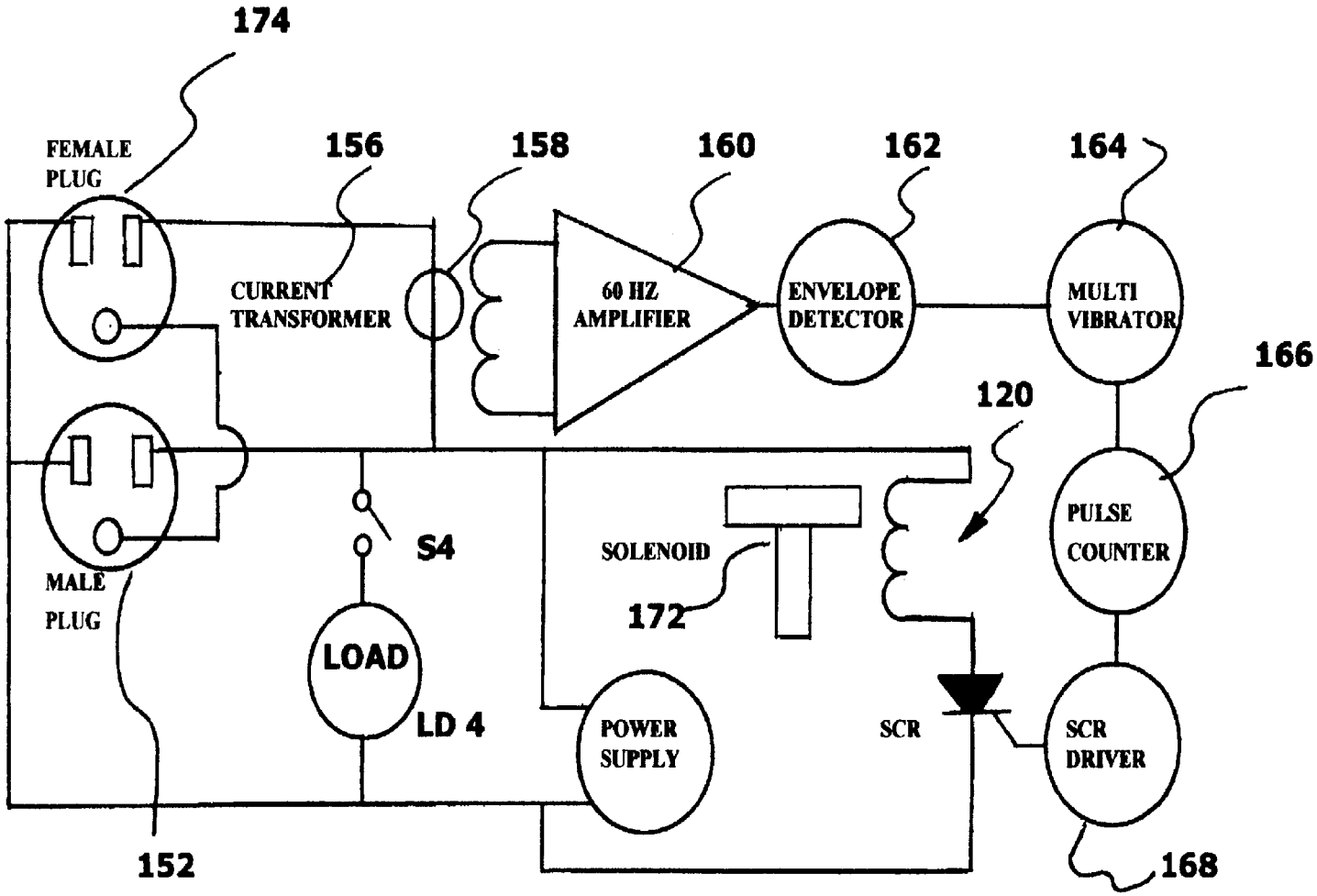
FIG. 4 is a schematic diagram of another electronic circuit for controlling a plug ejector according to this invention.
Figure 5:
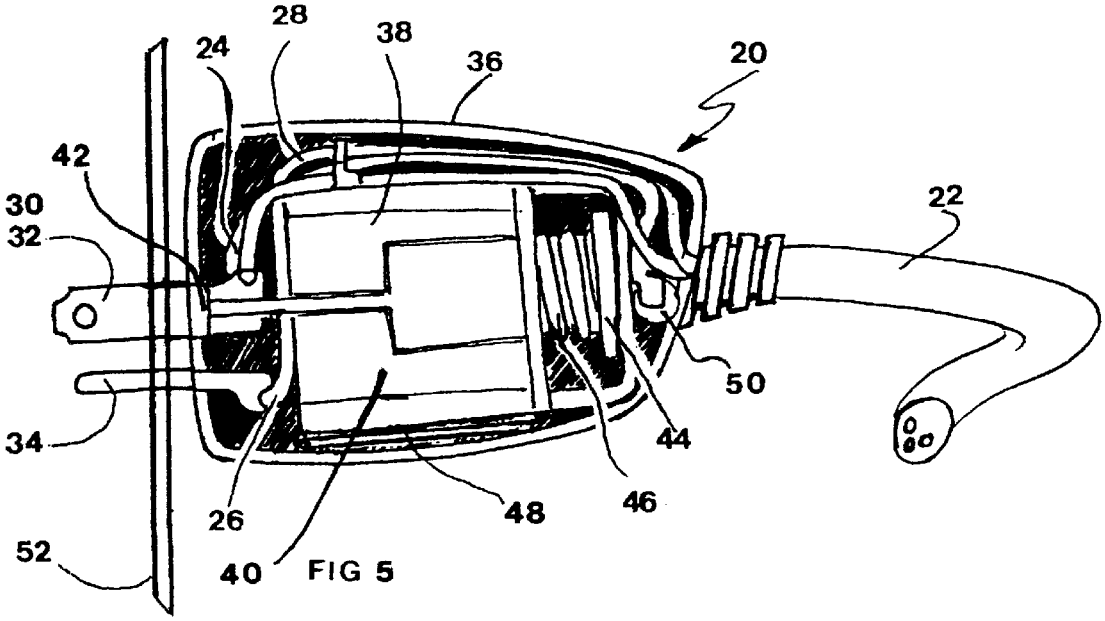
FIG. 5 is a cutaway perspective view of the one embodiment of a plug ejector according to this invention.

FIGS. 1–4 depict electronic circuits, which eliminate this fourth wire and extra switch, and utilize the appliance on/off operating switch and a standard three-wire line cord for controlling the plug ejector illustrated in FIG. 5. These circuits are exemplary only, and variations of these circuits, which incorporate the inventive functions contained therein, will occur to those skilled in the art. These circuits monitor the electrical power supply characteristics of an electrical appliance or other electrical device. When predetermined changes in these characteristics are sensed, each of these electronic circuits will trigger a motor, typically a solenoid, which operates an ejection member to quickly and completely separate or eject a power cord plug from an electrical power supply socket, as will be detailed later in reference to FIG. 5.

To initiate the plug ejection action, the appliance operator operates or cycles the appliance On/Off switch rapidly more than two times. The electronic circuits sense these changes in the electrical characteristics of the power supply and actuate the motor to eject the power cord plug from the socket. This eliminates the need for using a separate operating line, or fourth line cord wire, and switch.

Figure 1:
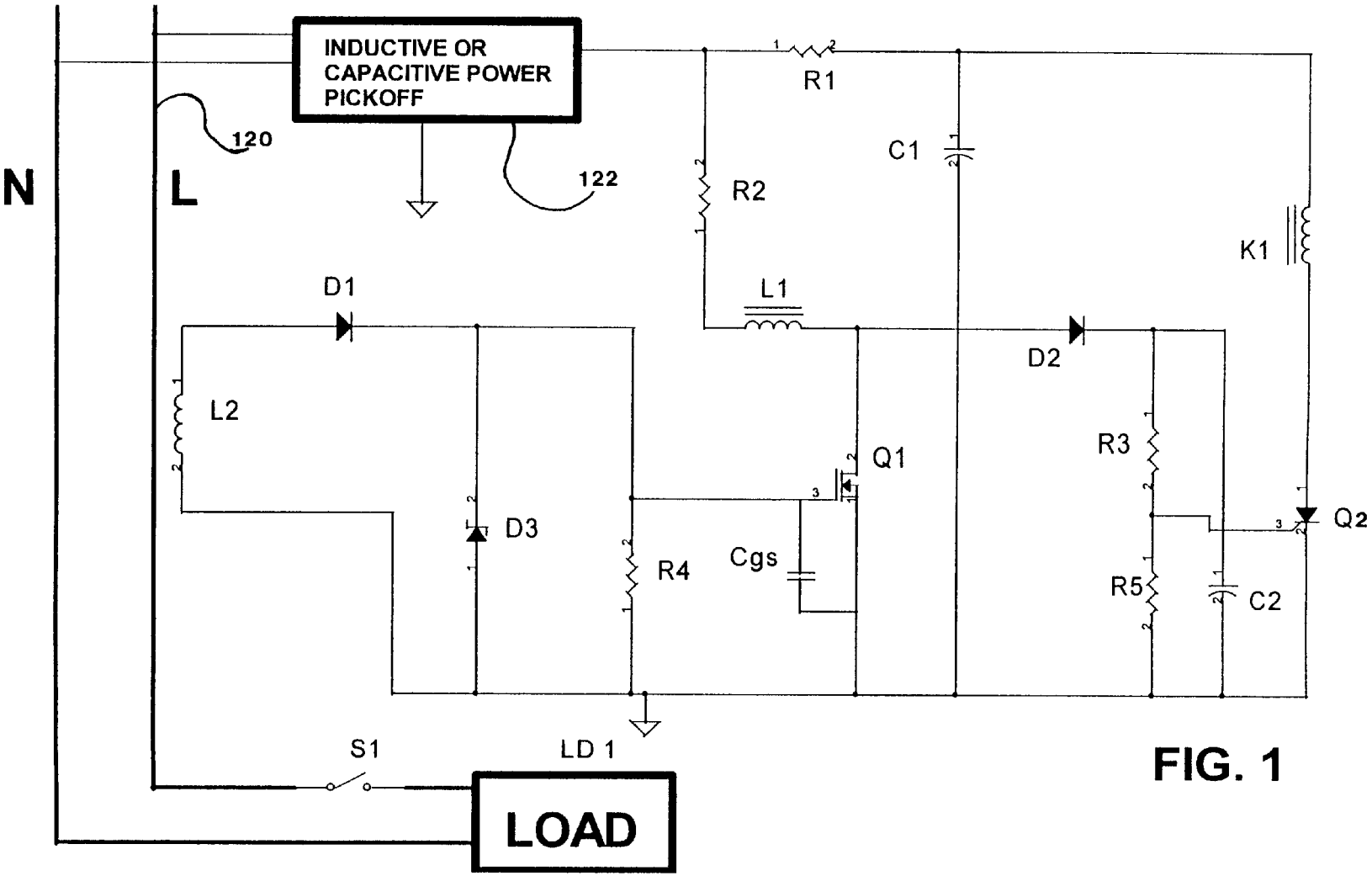
FIG. 1 is a schematic diagram of an analog electronic circuit for controlling a plug ejector according to this invention.

In the circuit shown in FIG. 1, power for the circuit is derived from a power line cord 120 for an appliance (load) LD1 having neutral and load conductors N and L via the Inductive or Capacitive Power Pickoff 122 by use of standard circuitry commonly found in the literature. When power line cord 120 is plugged into a conventional electrical power supply socket (not shown), and an appliance power switch S1 is turned On, electrical current flows through Inductive or Capacitive Power Pickoff 22 and Resistor R1 to charge Capacitor C1, through Resistor R2, Inductor L1, Diode D2 to charge Capacitor C2, and through Resistor R2, Inductor L1, Diode D2, and into Resistors R3 and R5 and is stored in Capacitor C1. The circuit is ready for the user to turn on the electrical appliance LD1. The energy stored in Capacitor C1 is available to eject the plug from the supply socket when the Ejector Solenoid K1 is engaged after SCR Q2 is triggered by multiple On/Off actions of appliance switch S1 by the user.

This triggering process relies on the load current in the appliance power cord Line 120 being sensed by the combination of an Inductive Pickoff Coil L2, a diode D1, and a resistor R4. The sensing of successive and multiple On/Off actions of appliance switch S1 causes the internal gate-to-source capacitor Cgs of N-Field Effect Transistor (NFET) Q1 to accumulate and store charge. This holds the Q1 drain-to-source terminals in a low impedance, conducting—ON, state. Energy is stored in Inductor L1 at this time, because of Q1 current flow. Diode D3 protects the circuit from line transients by clamping voltage across its terminals.

When a user interrupts operation of the appliance power load LD1 by a predetermined or threshold number of successive and multiple On/Off actions of appliance switch S1, resistor R4 allows the energy stored in capacitor Cgs of Q1 to dissipate. This turns Q1 off and causes fly-back action (as commonly understood in the literature) in L1 allowing current to flow through Diode D2 and into capacitor C2 charging C2.

Resistors R3 and R5 sense the voltage across Capacitor C2 and cause SCR Q2 to trigger when the voltage across R5 rises above SCR Q2's turn-on threshold. Capacitor C1 then discharges through Ejector Solenoid coil K1 causing the ejector member 124 to extend and eject the plug, as later described Proper component design will define the arbitrary number of sequential load current interruptions and associated interruption timing necessary to trigger SCR Q2 and, by this design, will guarantee that one load disconnection will not cause plug ejection.

Figure 2:
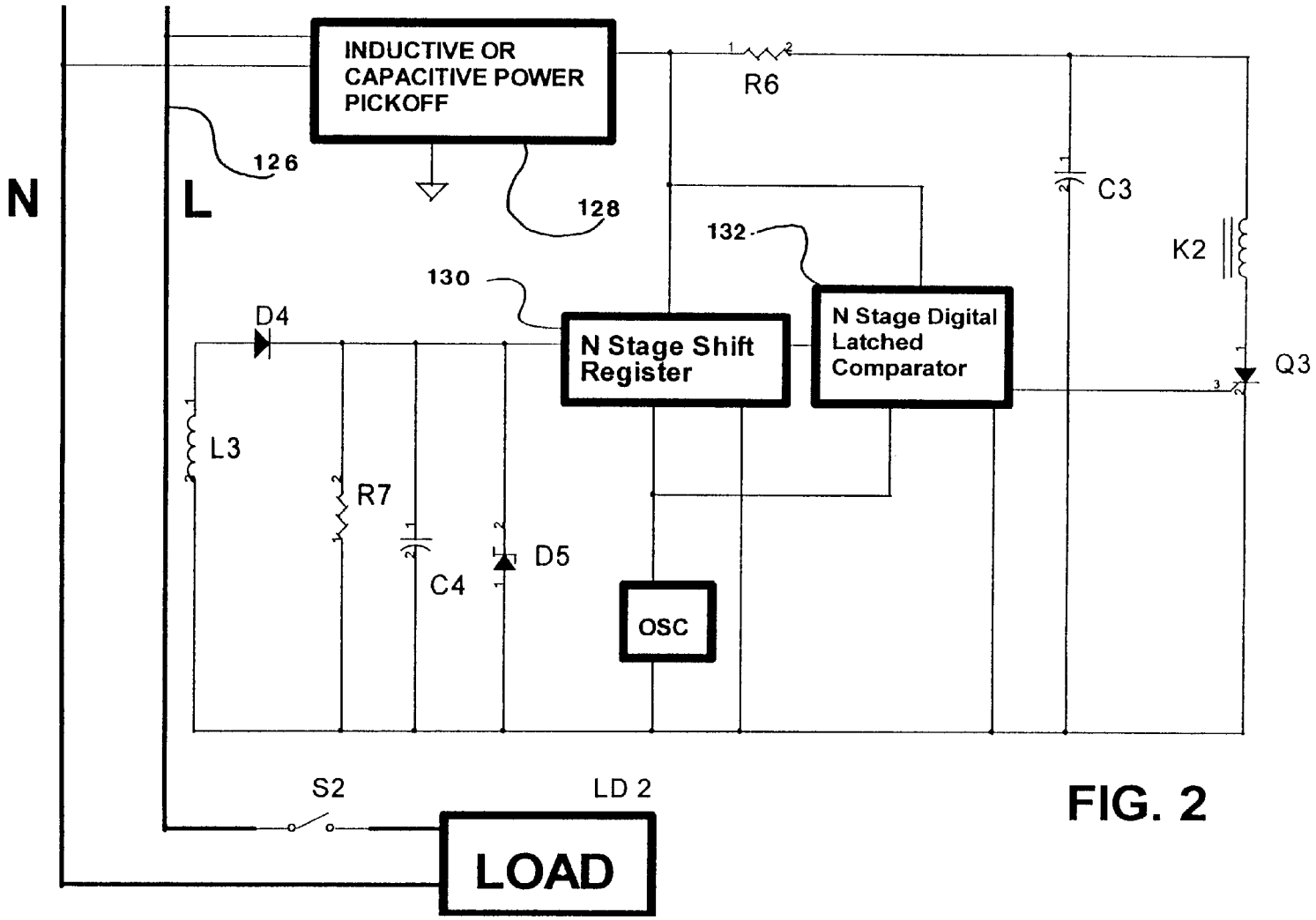
FIG. 2 is a schematic diagram of a logic-type electronic circuit for controlling a plug ejector according to this invention.

Another operating circuit is shown in FIG. 2. When the appliance LD2 power cord 126 is plugged into the wall socket (not shown) and the appliance power switch S2 is turned On, electrical current travels through the Inductive or Capacitive Power Pickoff 128 and Resistor R6 to charge Capacitor C3. The N-Staged Shift register 130 and Digital Latched Comparator 132 are both energized.

Appliance power cord load current in power cord 126 is monitored and sensed by an Inductor L3, a Diode D4, a Resistor R7, and a Capacitor C4. A diode D5 protects the circuit from line transients by clamping voltage across its terminals.

A free running oscillator OSC clocks (i.e. increments) N-Stage Shift Register 130, which creates a free running sampled data representation of the presence or absence of appliance power cord load current. N- Stage Digital Latched Comparator 132 forms a sequential and continuously running matched filter designed to detect a predetermined or threshold sequence of load interruptions that would indicate a request to eject the plug from the socket, disconnecting it from the power supply. The number of required load interruptions per unit time determines the oscillator OSC frequency and the number of stages needed in N- Stage Shift Register 30 and N- Staged Digital Latched Comparator 132. The output from N- Staged Digital Latched Comparator 132 triggers SCR Q3, discharging capacitor C3 through solenoid K2 and causing the ejector 134 to extend.

In the circuit shown in FIG. 3, when the appliance power cord 136 is plugged into the electrical power supply socket (not shown), and the appliance LD3 on/off power switch S3 is turned On, electrical current travels through the Inductive or Capacitive Power Pickoff 138 and a Resistor R8 to charge a capacitor C5. A Microprocessor 140 with integral Oscillator OSC is energized. The circuit is ready for the user to turn on appliance LD3.

In this embodiment, current sensing components Inductor L4, Diode D6, Resistor R9, and Capacitor C6 cause a voltage to be developed across Capacitor C6 when load current is flowing. Microprocessor 140 with integral Oscillator OSC samples this voltage and software algorithms internal to Microprocessor 140 detect a predetermined or threshold sequence of load interruptions per unit time and turns on SCR Q4, which engages the K3 Ejector solenoid. Diode D7 protects the circuit from line transients by clamping voltage across its terminals. This implementation places operation of the Plug Ejector under the versatile control of software algorithms, which can implement a variety of methods to detect the correct sequence of load interruptions that would indicate a request to eject a plug.

In the circuit embodiment of FIG. 4, when the appliance power switch S4 is rapidly cycled, the SCR driver energizes the solenoid. At the plug 152, one of the wires carrying current passes through a current transformer 156. A voltage pulse that is proportional to current appears on the winding 158 and is amplified by amplifier 160. The envelope configuration at 162 is detected and converted to a fixed width pulse by a multi-vibrator 164. The pulse occurs only when current is interrupted. A pulse counter 166 accumulates the pulses that occur during a predetermined time period. If the number of pulses counted exceeds an predetermined threshold, pulse counter 166 sends a signal to an SCR driver 168 to turn on, causing current to flow in a solenoid 170 for a fixed time period to extend ejector 172 and eject plug 152 from wall socket 174.

FIG. 5 shows an in-line ejector plug 20 that is mounted on the end of a three conductor power cord 22 which is connected to an electrical appliance, such as a vacuum sweeper, floor polisher, or other piece of electrical equipment (not illustrated) or is the distal end of a power extension cord. Power cord 22 contains a hot wire 24, a neutral wire 26 and a ground wire 28. These wires connect to respective plug prongs 30, 32 and 34, respectively, which protrude from the end of a molded plug housing 36.

An electric motor in the form of solenoid 38 is contained within housing 36 and includes an armature 40 having an impact tip 42 at one end that is extendable from housing 36 to serve as an ejector member. The other end of armature 40 has an enlarged head 44. A compression spring 46 is confined between the body of solenoid 38 and head 44 to bias the armature 40 to retract within housing 36. The electronic components and circuitry of FIGS. 1–4 are mounted on PC board 48.

In use, plug 20, incorporating a plug ejector, is plugged into a conventional electrical wall outlet socket, or any other conventional power supply outlet socket, such as a portable power center, by inserting prongs 30,32 and 34 into the socket openings in the face 52 of a wall outlet socket to provide power to the appliance connected to the other end of power cord 22. After the appliance is used and it is desired to remove plug 20 and withdraw it to the proximity of the appliance for redeployment in another wall outlet socket or for storage of the appliance, the appliance standard On/Off operating switch (not shown) is rapidly cycled more than two times. This energizes solenoid 38, which quickly extends armature 40 so that impact tip 42 strikes socket face 52 and forcibly withdraws plug prongs 30, 32 and 34 from the openings in wall socket face 52 to eject plug 20. Power cord 22 is now free to be pulled by the operator to the remote location of the appliance.

Figure 6:
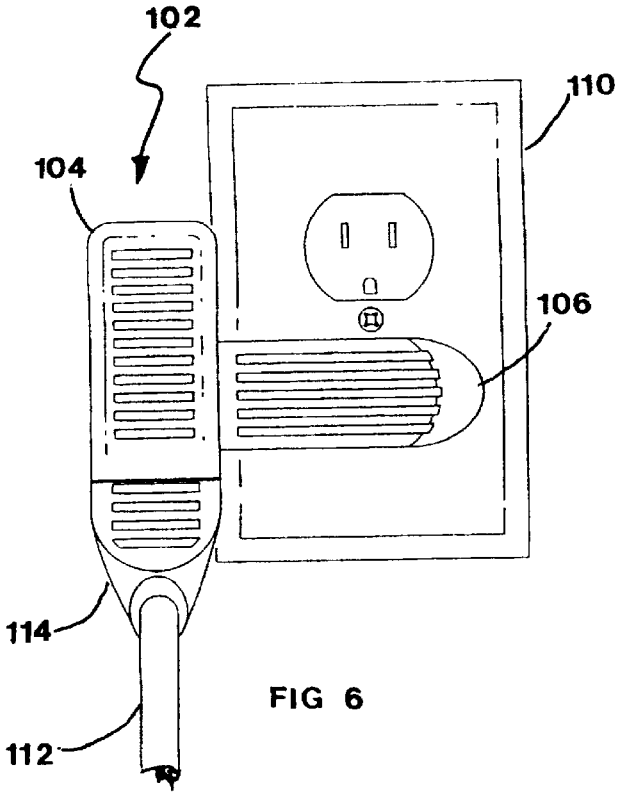
FIG. 6 is a front view of yet another embodiment of a plug ejector assembly according to this invention, showing a plug ejector module in an offset mounting to a wall socket.
Figures 7A, 7B:
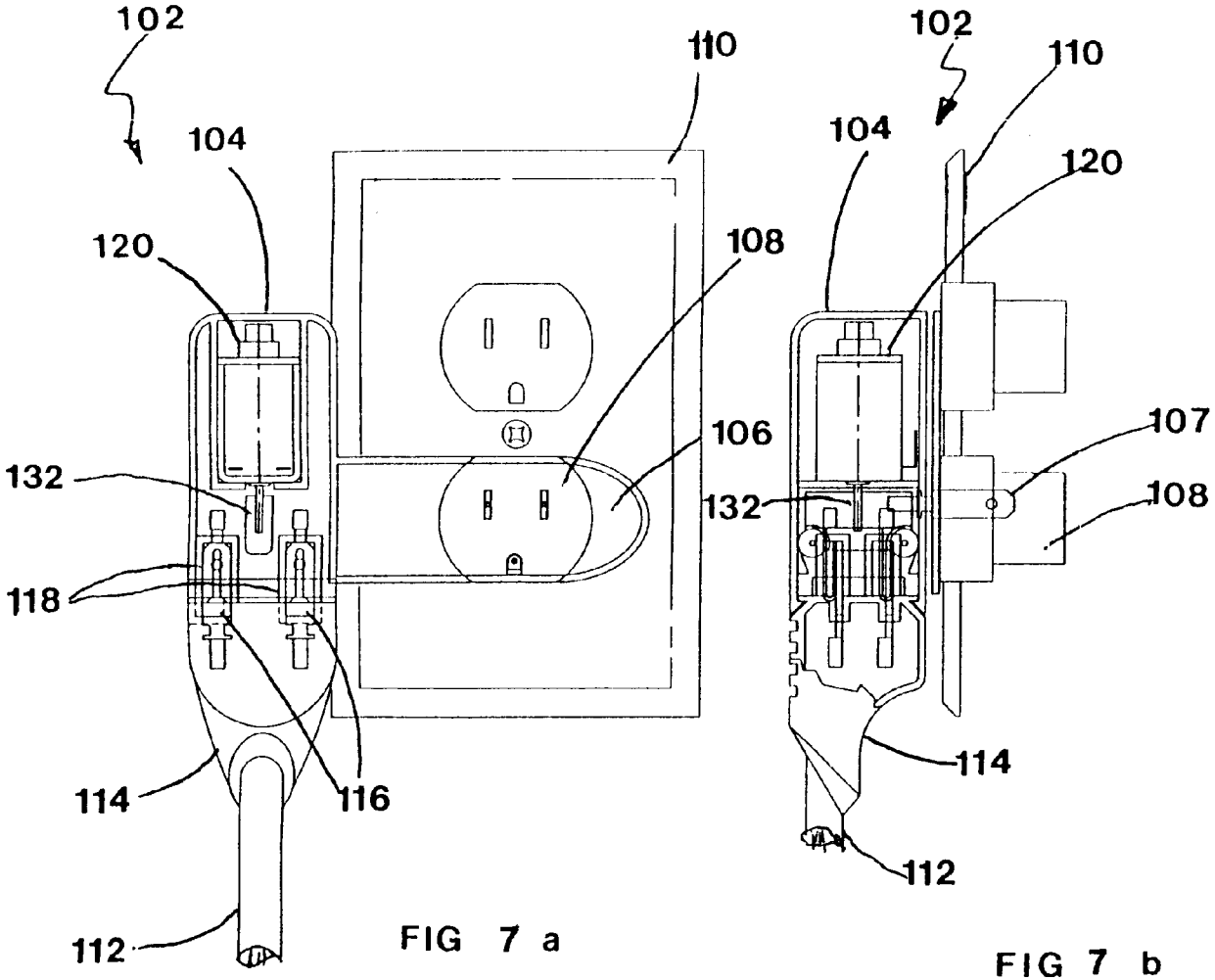
FIGS. 7*a* and 7*b* are cutaway views of the module shown in FIGS. 6 and 8.

Referring to FIGS. 6, 7*a* and 7*b*, a plug ejector module 102 comprises a main plug ejector housing 104 located laterally of its integral module plug 106 which has standard electrical prongs 107 that conventionally plug into a wall socket 108 mounted in a socket cover plate 110. A standard power line cord 112, which is connected at its distal end to an electrical appliance (not illustrated) or is mounted at the distal end of an extension cord, mounts a conventional 3-prong plug 114. In another embodiment, plug 114 can be an easily produced variation of the standard electrical plug, but none-the-less a special plug 114, having standard electrical prongs 116 that are plugged into, and ejectable from an adaptor socket 118. In this case, both socket 118 and plug 114 would be specially designed to minimize the frictional force connecting plug and socket to thus reduce the power of solenoid 120 required to eject plug 114.

Upon activation by cycling of an appliance On/Off switch (not shown) by a user of the appliance, solenoid 120 will extend and forcibly eject adaptor plug 114, cutting power to the appliance.

As shown in FIGS. 7*a* and 7*b*, upon activation, solenoid plunger 132 extends to engage and forcibly eject plug 114. This operation and the structural details of the plug ejector mechanism are more fully described reference to FIGS. 15*a*, 15*b* of my co-pending application Ser. No. 09/133015. Note that module 104 remains plugged into wall socket 108 after plug 114 is ejected. Thus, with this embodiment, a separate module 102 must be provided for each wall socket. However, the worker time saved from not having to walk 50 or 100 ft. to unplug the appliance plug, and then back again, saves productivity time that will quickly recoup the cost of the adaptor plug assemblies. Also, since the frictional force between the adaptor plug prongs and the adaptor socket can be controlled and minimized under the plug ejectors tight manufacturing methods, the cost of ejection components can be minimized. Preferably, module 102 is permanently or semi-permanently secured to wall socket 108.

Figure 8:
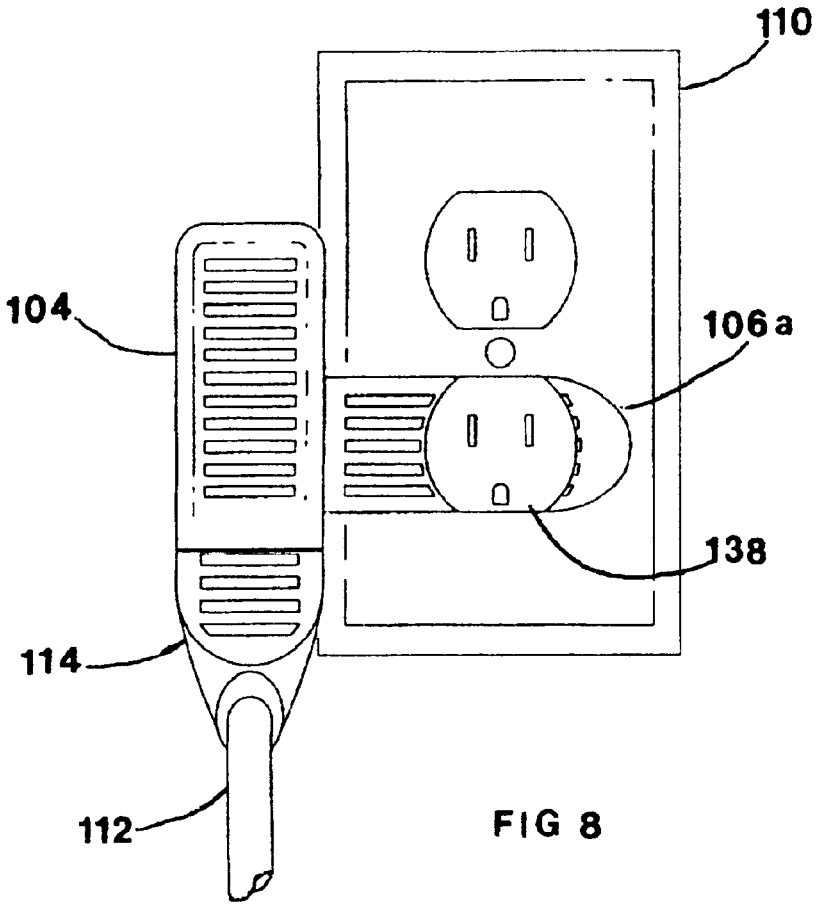
FIG. 8 is a plan view of another embodiment of plug ejector module of FIG. 8, featuring an accommodation for continuation of a wall socket aperture.

FIG. 8 shows a modified embodiment which in which module plug 106*a* incorporates a plug through-socket 138 which can accommodate any plug from any other electrical appliance, thus allowing full use of the socket while the plug ejector is plugged into the wall socket but not in use.

Figure 9:
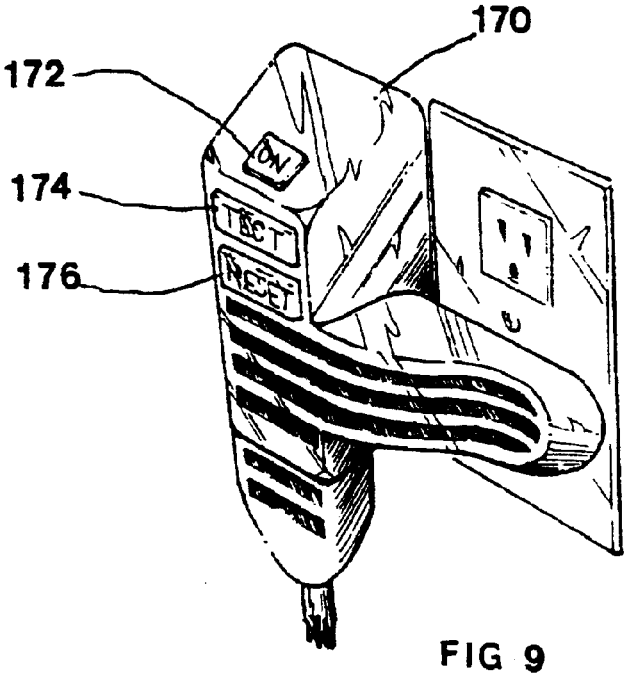
FIG. 9 is a perspective view of another embodiment of plug ejector module that incorporates a ground fault circuit interrupt (GFCI) device.

In FIG. 9, another embodiment of a plug ejector module 170 incorporates a conventional ground fault circuit interruption (GFCI) device having "on" 172, "test" 174 and "reset" 176 buttons. This embodiment is particularly useful in construction jobs outside, which require operation in all types of weather.

FIGS. 10–12 illustrate a plug ejector which is incorporated into an adaptor that enables existing appliances and extension cords, having standard line cord plugs, to be retrofitted. In each embodiment shown, the ejector in the adaptor ejects the adaptor from a wall socket or other conventional electrical power supply socket.

In FIG. 10, an adaptor 180 has prongs 182, which plug into the socket 184 of a wall socket 186. The ejector mechanism (solenoid, ejector and PC board containing the electronic components and circuitry of FIGS. 1–4) 188 extends from the front face 190 of adaptor 180. The rear face includes a standard 3-prong socket 192.

FIG. 11 illustrates adaptor 180 plugged into wall socket 186, with prongs of a plug 194, mounted on the distal end of the power line cord 196 of an electrical appliance, here in the form of a vacuum cleaner 198, poised for insertion into socket 192. Rapid cycling of the appliance's on/off operating switch will operate the plug ejector of adaptor 180. Thus, through the use of adaptor 180, any existing appliance can be easily and inexpensively converted to automatic remote plug ejection without modification by plugging its line cord, or intervening extension cord plug into the adaptor.

FIG. 12 illustrates an adaptor 200, internally identical to adaptor 180, mounted on the distal end of an extension cord 202, which has a 3-prong socket 204 mounted on its proximate end. By mounting the plug ejector adaptor 200 on the end of an extension cord, current electrical appliances, such as vacuum cleaners, having relatively short power cords that minimize operating range, can 1 incorporate remote plug ejection and also greatly extend operating range.

While only preferred embodiments of this invention have been illustrated and described, obvious modifications thereof are contemplated within the scope of the following claims.

I claim:

1. A plug ejector for ejecting an electrical plug from an electric power supply socket, comprising an electric ejector motor having an ejector member and a controller for monitoring and sensing the presence or absence of electrical load current through said plug and for controlling energization of the motor, whereby a predetermined sequence of load current interruptions causes energization of the electric motor to extend the ejector member and eject the plug from the socket.

2. The plug ejector of claim 1, wherein the plug ejector is mounted in a plug on an electrical supply cord, which supplies electrical power to an electrical appliance, and the ejector member extends to impact the electrical power supply socket and eject the plug.

3. The plug ejector of claim 2, wherein the electrical appliance has an on/off operating power switch and a predetermined rapid actuation of the on/off switch causes said predetermined sequence of load current interruptions.

4. The plug ejector of claim 1, wherein the ejector is mounted in an adaptor which mounts on the plug of an electrical supply cord that supplies electrical power to an electrical appliance, and has prongs insertable into a conventional electrical power supply socket, whereby said predetermined sequence of load current interruptions causes energization of the electric motor to extend the ejector member to impact the conventional electrical power supply socket and eject the adaptor.

5. The plug ejector of claim 4, wherein the electrical appliance has an on/off operating power switch and a predetermined rapid actuation of the on/off switch causes said predetermined sequence of load current interruptions.

6. The plug ejector of claim 1, wherein the ejector is mounted in a module that is installed in a conventional electrical power supply socket and has a module socket for receiving a plug mounted on an electrical supply cord, which supplies electrical power to an electrical appliance, and the ejector member extends to impact the electrical power supply socket and eject the plug.

7. The plug ejector of claim 6, wherein the electrical appliance has an on/off operating power switch and a predetermined rapid actuation of the on/off switch causes said predetermined sequence of load current interruptions.

8. The plug ejector of claim 1, including an electrical overload protector.

9. The plug ejector of any of claims 2, 4 or 6, wherein the controller includes a comparator which compares the power, current and voltage characteristics with predetermined values of these characteristics to energize said motor to determine when said predetermined sequence of load current interruptions has occurred.

10. The plug ejector of any of claims 3, 5 or 7, wherein the controller includes a microprocessor having an algorithm which analyzes the on/off switch actuation to control energization of said electric motor.

11. The plug ejector of any of claims 3, 5 or 7, wherein the controller includes a comparator which compares the rate and frequency of on/off switch actuation with said predetermined rate and frequency to energize said electric motor when said predetermined sequence of load current interruptions has occurred.

12. The plug ejector of any of claims 3, 5 or 7, wherein the controller includes a voltage pulse counter which counts the number of voltage pulses caused by on/off switch actuation to energize the motor when a threshold number of pulses has been counted in a predetermined time period.

* * * * *